US010710140B2

(12) United States Patent
Lewis

(10) Patent No.: US 10,710,140 B2
(45) Date of Patent: Jul. 14, 2020

(54) TOOLING ASSEMBLY, BLANKING TOOL THEREFOR AND ASSOCIATED METHOD

(71) Applicant: STOLLE MACHINERY COMPANY, LLC, Centennial, CO (US)

(72) Inventor: Jared A. Lewis, Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 89 days.

(21) Appl. No.: 15/375,482

(22) Filed: Dec. 12, 2016

(65) Prior Publication Data

US 2017/0087618 A1 Mar. 30, 2017

Related U.S. Application Data

(63) Continuation of application No. 13/036,103, filed on Feb. 28, 2011, now abandoned.

(Continued)

(51) Int. Cl.

| | |
|---|---|
| ***B21D 28/06*** | (2006.01) |
| ***B21D 22/28*** | (2006.01) |
| ***B21D 51/26*** | (2006.01) |

(52) U.S. Cl.

CPC ..... *B21D 28/06* (2013.01); *B21D 22/28* (2013.01); *B21D 51/26* (2013.01); *Y10T 83/06* (2015.04); *Y10T 83/9447* (2015.04)

(58) Field of Classification Search

CPC ..... B21D 28/06; B21D 51/26; B21D 22/28

See application file for complete search history.

(56) References Cited

U.S. PATENT DOCUMENTS 110,396 A 12/1870 Ross
155,098 A * 9/1874 Merriken ..... B21D 28/06 72/336

(Continued)

FOREIGN PATENT DOCUMENTS

JP 49-113284 1/1948
JP 56053827 5/1981

(Continued)

OTHER PUBLICATIONS

Japanese Office Action dated October 14, 2014 Translation.
International Search Report dated Feb. 28, 2011 for International Application No. PCT/US2011/026438.

*Primary Examiner* — Sean M Michalski

(74) *Attorney, Agent, or Firm* — Eckert Seamans Cherin & Mellott, LLC

(57) ABSTRACT

A blanking tool is provided for cutting blanks from a sheet of material. The sheet of material includes a product area where the blanks are located, and a web area, which is the area between the blanks. The blanking tool includes a shear having first and second opposing sides, an outer diameter, and an inner diameter. A plurality of contact surfaces are disposed on the second side of the shear. The contact surfaces engage only the web of the material. A tooling assembly is also disclosed, which includes first and second tooling coupled to first and second opposing portions, respectively, of a press and being structured to cooperate to engage the sheet of material therebetween. The blanking tool is coupled to the first tooling, and the shear of the blanking tool cooperates with a portion of the second tooling to cut the blanks from the material.

15 Claims, 13 Drawing Sheets

Related U.S. Application Data

(60) Provisional application No. 61/312,316, filed on Mar. 10, 2010.

(56) References Cited

U.S. PATENT DOCUMENTS 353,439 A * 11/1886 Butters ..... B21D 22/28 72/349
384,532 A * 6/1888 Knowlton ..... B26D 3/12 83/682
1,103,966 A * 7/1914 Holinger ..... B21D 28/06 72/336
1,202,546 A * 10/1916 McDonald ..... B21D 28/06 83/165
1,369,234 A * 2/1921 Freund ..... B21D 28/14 83/681
1,375,305 A * 4/1921 Maisel ..... B21D 22/28 72/329
1,431,541 A * 10/1922 Randall ..... B26F 1/3866 83/126
1,621,811 A * 3/1927 Richard ..... B21D 28/34 279/30
1,817,223 A * 8/1931 Abramson ..... B23B 45/06 29/263
2,086,435 A * 7/1937 Rapp ..... C14B 5/02 30/301
2,096,778 A * 10/1937 Azer ..... B21D 28/343 30/360
2,545,237 A * 3/1951 Maby ..... B26F 1/32 30/130
2,735,489 A * 2/1956 Fowler ..... B21D 28/343 30/360
2,928,451 A * 3/1960 Taylor ..... B21D 22/04 267/152
3,060,992 A * 10/1962 Hopp ..... B21D 35/00 72/327
3,252,315 A * 5/1966 Muench ..... B21D 53/32 72/309
3,263,465 A * 8/1966 Way ..... B21D 41/045 72/294
3,319,452 A * 5/1967 Rethwish ..... B21D 13/02 72/309
3,496,753 A * 2/1970 Gibbings ..... B21D 53/265 72/336
3,606,565 A * 9/1971 Riggs ..... B23B 51/0426 137/318
3,656,394 A * 4/1972 McCutcheon ..... B26F 1/14 83/689
3,683,499 A * 8/1972 Robinson, Jr. ..... B21D 28/343 30/360
3,996,832 A * 12/1976 Schubert ..... B26F 1/14 83/686
4,002,092 A * 1/1977 Smith ..... B23B 51/0406 83/55
4,277,891 A * 7/1981 Dick ..... B26B 9/02 30/316
4,362,078 A * 12/1982 Ohnishi ..... B21D 28/16 83/50
4,403,417 A * 9/1983 Wilson ..... B21D 28/343 30/360
4,620,434 A * 11/1986 Pulciano ..... B21D 22/30 72/347
4,846,033 A * 7/1989 Uehlinger ..... B23D 19/065 83/94
4,899,447 A * 2/1990 Adleman ..... B21D 28/343 30/360
4,977,772 A * 12/1990 Bulso, Jr. ..... B21D 51/38 72/336
5,005,396 A * 4/1991 DeSmet ..... B21D 22/10 72/309
5,024,077 A * 6/1991 Bulso, Jr. ..... B21D 22/24 413/1
5,029,392 A * 7/1991 Bingham ..... B21D 28/343 30/360
5,052,207 A * 10/1991 Porucznik ..... B21D 28/14 72/329
5,052,258 A * 10/1991 Hunter ..... B26F 1/36 30/229
5,056,392 A * 10/1991 Johnson ..... B21D 45/006 83/140
5,105,645 A * 4/1992 Kobayashi ..... B21D 51/26 72/348
5,235,881 A * 8/1993 Sano ..... B21D 28/16 72/333
5,316,169 A * 5/1994 Gallagher ..... B21D 51/26 220/658
5,423,240 A * 6/1995 DeTorre ..... B23D 35/001 30/350
5,522,248 A * 6/1996 Diekhoff ..... B21D 22/30 72/348
5,604,044 A * 2/1997 McCabe ..... B21D 22/22 220/62
5,626,048 A * 5/1997 McClung ..... B21D 22/22 72/336
5,630,337 A * 5/1997 Werth ..... B21D 22/28 72/349
5,692,409 A * 12/1997 Cheers ..... B21D 22/28 72/349
5,727,436 A * 3/1998 Swedberg ..... B21D 28/343 30/360
5,740,692 A * 4/1998 Dunwoody ..... B21D 22/28 72/347
D397,277 S * 8/1998 Gibbs, Jr. ..... B21D 22/28 D7/672
5,802,907 A * 9/1998 Stodd ..... B21D 22/28 72/336
5,881,593 A * 3/1999 Bulso, Jr. ..... B21D 22/24 72/336
5,881,611 A * 3/1999 Wagner ..... B26F 1/3846 264/153
6,032,504 A * 3/2000 Onat ..... B21D 22/02 72/297
6,070,507 A * 6/2000 Mihalov ..... B29C 65/18 264/153
6,499,329 B1 * 12/2002 Enoki ..... B21D 22/30 72/348
6,634,203 B1 * 10/2003 Ras ..... B21D 22/28 413/69
6,973,729 B2 * 12/2005 Nordlin ..... B21D 28/34 30/360
7,124,613 B1 * 10/2006 McClung ..... B21D 22/30 72/348
7,228,776 B2 * 6/2007 Case ..... B21D 28/343 279/8
7,240,531 B2 * 7/2007 Turnbull ..... B21D 51/26 72/347
8,414,464 B2 * 4/2013 Grischenko ..... B31B 70/00 493/143
9,254,526 B2 * 2/2016 Nordlin ..... B26F 1/386
9,393,607 B2 * 7/2016 Nordlin ..... B21D 28/34
2002/0023474 A1 * 2/2002 McClung ..... B21D 22/24 72/348
2004/0046284 A1 * 3/2004 Johns ..... B29C 43/42 264/320
2005/0056133 A1 * 3/2005 Huang ..... B26F 1/14 83/686
2010/0116014 A1 * 5/2010 Goda ..... B21D 22/28 72/349
2010/0147938 A1 * 6/2010 Littlejohn ..... B65D 1/34 229/407
2011/0015051 A1 * 1/2011 Grischenko ..... B31B 70/00 493/52

(56) References Cited

U.S. PATENT DOCUMENTS

FOREIGN PATENT DOCUMENTS

| | | |
|---|---|---|
| JP | 1284433 | 11/1989 |
| JP | 8-507474 | 9/1994 |
| JP | 2001-025830 | 1/2001 |
| WO | WO2009019832 | 2/2009 |

* cited by examiner

TOOLING ASSEMBLY, BLANKING TOOL THEREFOR AND ASSOCIATED METHOD

CROSS-REFERENCE TO RELATED APPLICATION

This application is a continuation of, and claims priority under 35 U.S.C. § 120 from, U.S. patent application Ser. No. 13/036,103, filed Feb. 28, 2011, and entitled "TOOLING ASSEMBLY, BLANKING TOOL THEREFOR AND ASSOCIATED METHOD," which claims priority from U.S. Provisional Patent Application Ser. No. 61/312,316, filed Mar. 10, 2010, entitled "TOOLING ASSEMBLY, BLANKING TOOL THEREFOR AND ASSOCIATED METHOD," the contents of which are incorporated herein by reference.

BACKGROUND

Field

The disclosed concept relates generally to tooling assemblies and, more particularly, to tooling assemblies for forming containers. The disclosed concept also relates to blanking tools and associated methods.

Background Information

It is generally well known to draw and iron a sheet metal blank to make a thin walled container or can body for packaging beverages (e.g., carbonated beverages; non-carbonated beverages), food or other substances. Tooling assemblies for forming cups or container bodies have conventionally involved forming material (e.g., without limitation, a sheet metal blank) conveyed between the punch and the die of a press. Typically, the blank is cut (e.g., sheared) from a substantially flat sheet of material (e.g., without limitation, aluminum; steel), which is typically supplied in a coil or stacked sheets. The punch then extends downwardly into the die, forming the blank into a cup or can body. See, for example and without limitation, in U.S. Pat. Nos. 7,124,613 and 7,240,531, which are hereby incorporated herein by reference.

FIGS. 1A and 2, for example, show a conventional blanking tool 2 having a 4-point shear 4 for cutting or shearing blanks 6 from material 8 (e.g., without limitation, sheet metal), as shown in FIG. 3. Specifically, the material 8 is conveyed to a press (not shown), and the shear 4 is compressed against the material 8 to cut or shear the blanks 6 (FIGS. 3 and 4). In doing so, the shear 4 and, in particular, a number of high points 10,12,14,16,18,20,22,24 (e.g., surfaces which extend outwardly from the bottom of the blanking tool 2, as best shown in FIG. 2) of the shear 4, engage and are compressed against the material 8. The contact areas, or locations at which the high points 10,12,14,16,18,20,22,24 engage the material 8, are best shown in FIG. 3. Specifically, it will be appreciated that high points 10,12,14,16 at least partially engage, and are compressed against, the product area 26 of the material 8, whereas high points 18,20,22,24 engage the web 28 (e.g., the area of scrap material between blanks 6, sometimes referred to as the "skeleton") of the material 8. The product area 26 is the area which is subsequently formed into a cup 30 (FIG. 5). Thus, the high points 10,12,14,16 can undesirably scratch or otherwise blemish (e.g., without limitation, scuff; mar) the blank 6 (FIG. 4), which can translate into a defect in the cup 30 (FIG. 5), and ultimately cause a problem with the finished product (e.g., without limitation, beer/beverage can; food can) (not shown)). For example, see blemished area 32 in the cup 30 of FIG. 5, resulting from the contact area 10 (FIGS. 3 and 4) of the shear 4 engaging and damaging the blank 6 (FIGS. 3 and 4) during the blanking process. It will be appreciated that such damage can occur on the opposite side (e.g., outside) of the cup 30 (i.e., bottom side of the blank 6) by the material 8 being engaged and compressed on the opposite side of the high points 10,12,14,16 by the stock plate (not shown) of the press (not shown).

As shown in FIGS. 6A, 6B and 7, the same problems are associated with conventional blanking tools 52 (FIG. 6A) having a 6-point shear 54 (FIG. 6A). Specifically, the 6-point shear 54 includes a number of high points 60,62,64,66,68,70,72,74,76,78,80,82, which engage and are compressed against the material 8' when forming blanks 6', as shown in FIG. 7. That is, high points 60,62,64,66,68,70 engage, and are compressed against, the product area 26' of the web 8' during the blanking process. High points 72,74,76,78,80,82, on the other hand, engage the web 28' (e.g., the area of scrap material between blanks 6') of the material 8'. Accordingly, like the 4-point shear 4 discussed hereinabove with respect to FIGS. 1A-4, portions of the 6-point shear 54 also engages and, therefore, can scratch or otherwise blemish (e.g., without limitation, scuff; mar) the blank 6' (FIG. 7).

There is, therefore, room for improvement in tooling assemblies, as well as in blanking tools and associated methods for making cups and containers.

SUMMARY

These needs and others are met by embodiments of the disclosed concept, which are directed to a tooling assembly, blanking tool and associated method. Among other benefits, the blanking tool effectively shears blanks without contacting the blanks themselves and potentially causing damage (e.g., without limitation, scratched or otherwise blemished).

As on aspect of the disclosed concept, a blanking tool is provided for cutting a number of blanks from a sheet of material. The sheet of material includes a product area corresponding to the area of the material where the blanks are located, and a web area corresponding to the area of the material between the blanks. The blanking tool comprises: a shear including a first side, a second side disposed opposite the first side, an outer diameter, and an inner diameter; and a plurality of contact surfaces disposed on the second side of the shear. The contact surfaces are structured to engage only the web of the material.

As another aspect of the disclosed concept, a tooling assembly is provided for a press. The press is structured to receive a sheet of material to perform a number of machining operations thereto. The tooling assembly comprises: first tooling structured to be coupled to a first portion of the press; second tooling structured to be coupled to a second portion of the press opposite the first tooling, the first tooling and the second tooling being structured to cooperate to engage the sheet of material therebetween; and a blanking tool coupled to the first tooling, the blanking tool comprising: a shear including a first side, a second side disposed opposite the first side, an outer diameter, and an inner diameter, and a plurality of contact surfaces disposed on the second side of the shear. The shear of the blanking tool cooperates with a portion of the second tooling to cut a number of blanks from the material. The material includes a product area corresponding to the area of the material where the blanks are located, and a web corresponding to the area of the material between the blanks. The contact surfaces of the blanking tool engage only the web.

As a further aspect of the disclosed concept, a method for forming blanks comprises: providing a press including first tooling and second tooling disposed opposite the first tooling; coupling a blanking tool to the first tooling, the blanking tool comprising a shear including a first side, a second side disposed opposite the first side, and a plurality of contact surfaces disposed on the second side; feeding a sheet of material between the first tooling and the second tooling; and actuating the press to engage the sheet of material with the shear, thereby cutting a number of blanks from the material. The sheet of material includes a product area corresponding to the area of the material where the blanks are located, and a web corresponding to the area of the material between the blanks, and the contact surfaces of the blanking tool engage only the web.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1B:
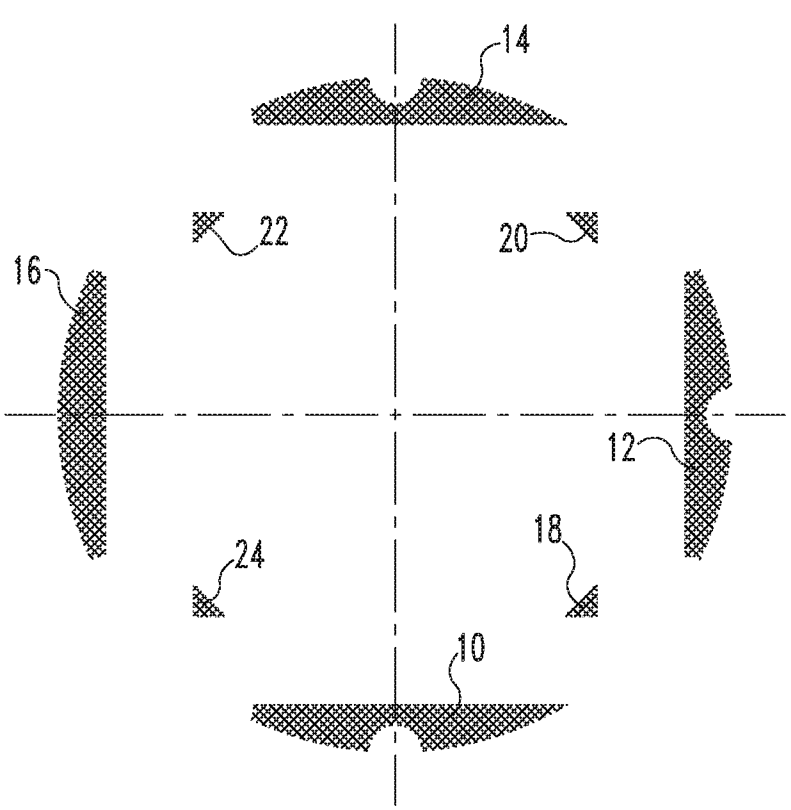
FIG. 1B PRIOR ART
FIG. 1B is a plan view of the contact areas of the 4-point shear of FIG. 1A.

For purposes of illustration, embodiments of the disclosed concept will be described as applied to cutting (e.g., shearing) blanks from a sheet of material (e.g., without limitation, sheet metal) to subsequently form cups and containers (e.g., without limitation, beverage/beer cans; food cans) from the blanks, although it will become apparent that they could also be employed to suitably cut (e.g., shear) blanks of any known or suitable material for a wide variety of different purposes and uses.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, left, right, front, back, top, bottom, upper, lower and derivatives thereof, relate to the orientation of the elements shown in the drawings and are not limiting upon the claims unless expressly recited therein.

As employed herein, the terms "fastener" and "fastening mechanism" refers to any suitable connecting or tightening mechanism for securing one component to another expressly including, but not limited to, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 8:
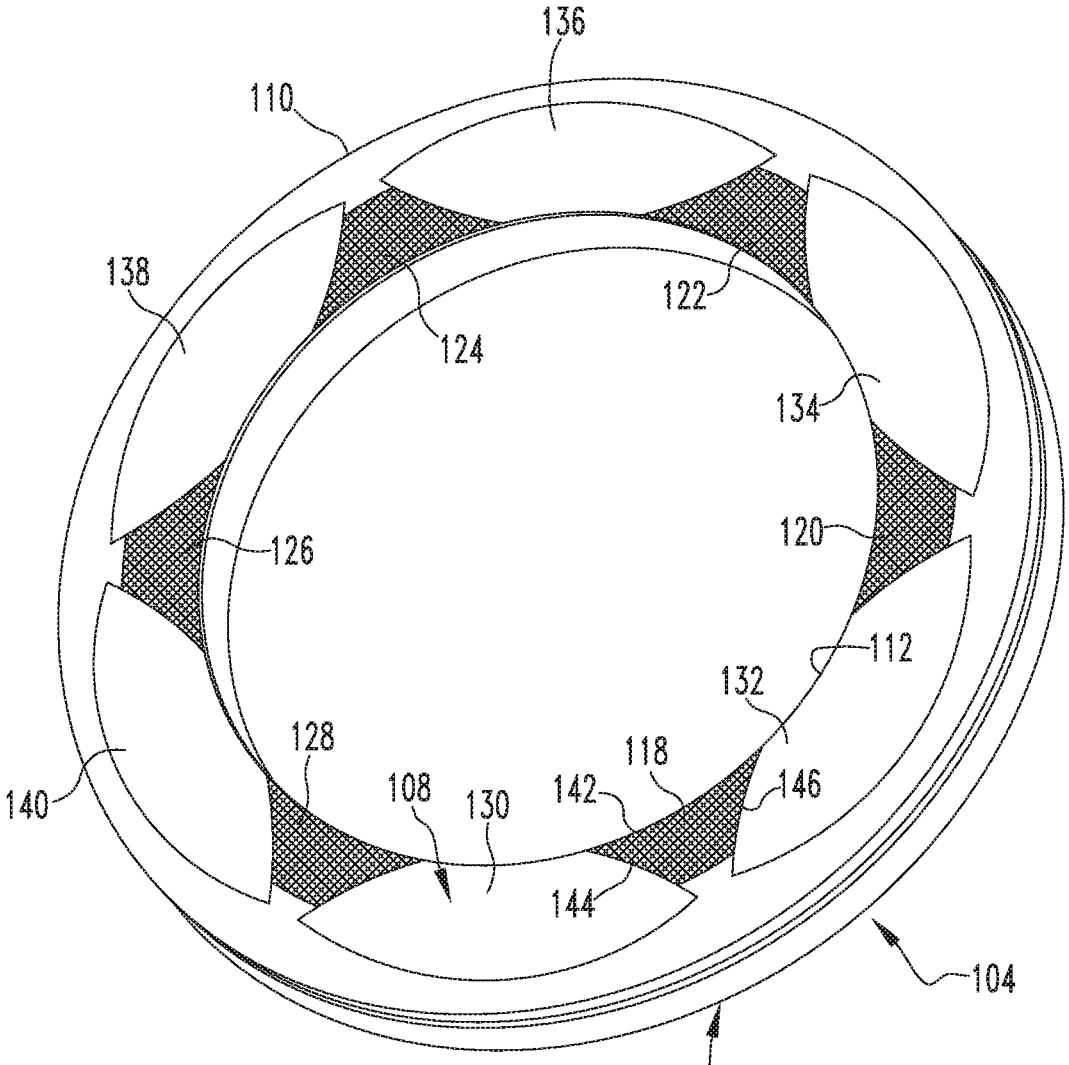
FIG. 8 is an isometric view of a blanking tool, in accordance with an embodiment of the disclosed concept.
Figure 9B:
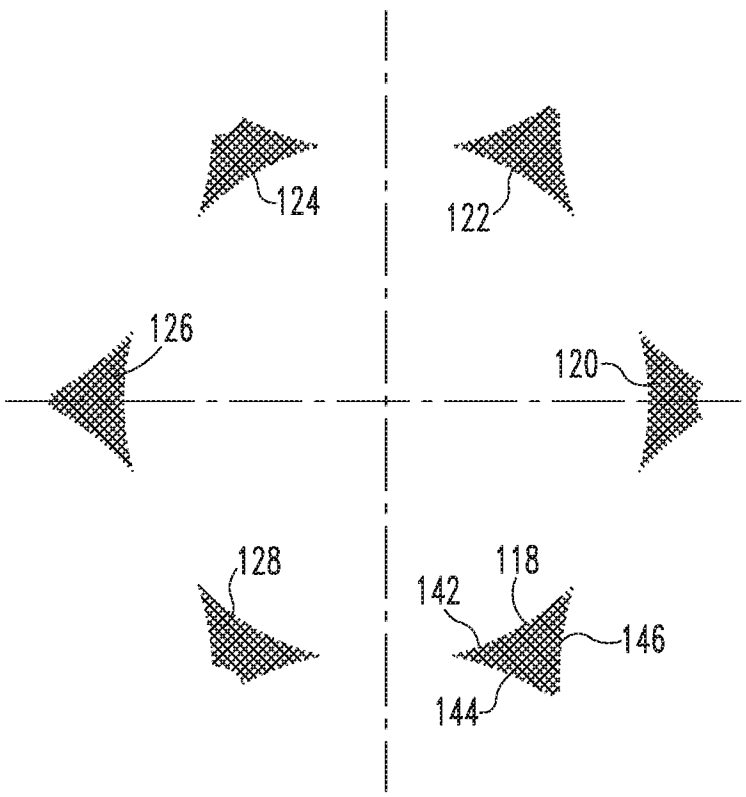
FIG. 9B is a plan view of the contact points of the blanking tool of FIG. 9A.
Figure 9A:
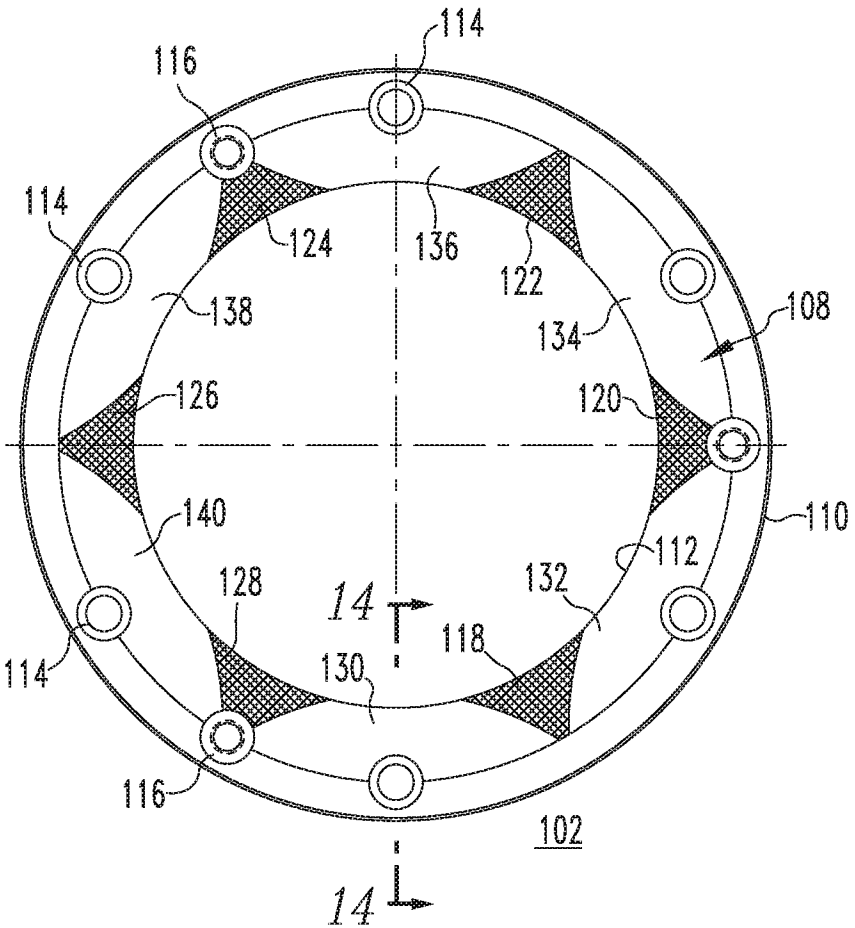
FIG. 9A is a bottom plan view of the blanking tool of FIG. 8.
Figure 15:
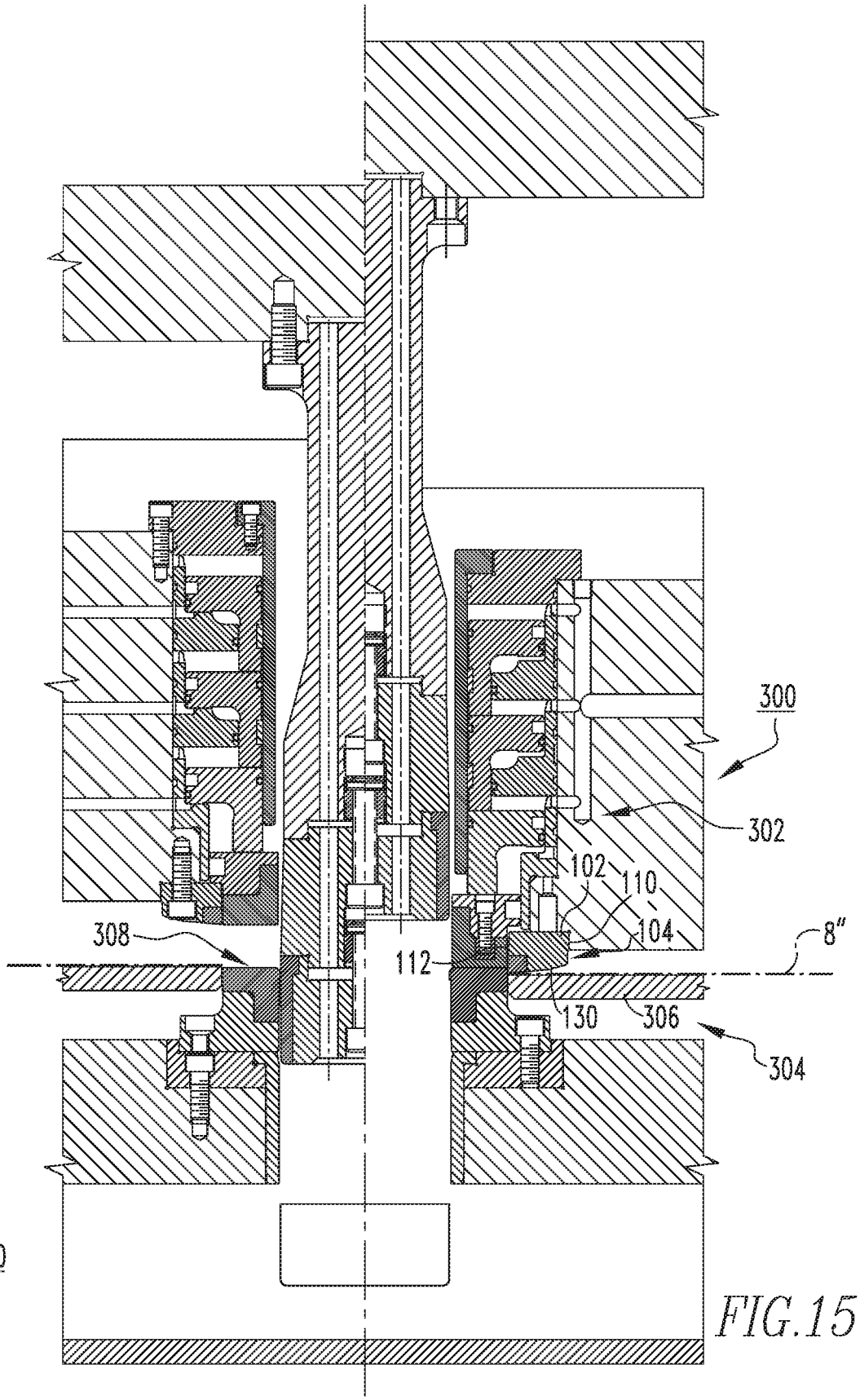
FIG. 15 is a side elevation section view of a press incorporating a tooling assembly and blanking tool therefor, in accordance with an embodiment of the disclosed concept.

FIGS. 8 and 9A show a blanking tool 102 for use with a tooling assembly 300 (FIG. 15) of a press 400 (FIG. 15). In the example shown and described herein, the blanking tool 102 is a six-point shear 104 (i.e., cutedge), although it will be appreciated that the disclosed concept could be employed with a shear (not shown) having any known or suitable alternative number, shape and/or configuration of points (e.g., without limitation, a four-point shear (not shown)).

The example shear 104 includes opposing first and second sides 106,108, an outer diameter 110, and an inner diameter 112. The specific dimensions of the outer diameter 110 and the inner diameter 112 are not meant to be limiting aspects of the disclosed concept. It will be appreciated, however, that the inner diameter 112 of the shear 104 is generally the same size as the diameter of the blanks 6" (FIG. 10), which are cut (e.g., sheared) by the shear 104. A plurality of contact surfaces 118,120,122,124,126,128 (six are shown) are disposed on the second side 108 of the shear 104. The contact surfaces 118,120,122,124,126,128 constitute high points, or locations which extend outwardly from the second side 108 of the shear 104. In the non-limiting example shown and described herein, the contact surfaces 118,120,122,124,126,128 are formed by machining (e.g., without limitation, grinding) the second side 108 of the shear 104 to form a plurality of machined surfaces 130,132,134,136,138,140, each of which is disposed between a corresponding pair of the aforementioned contact surfaces 118,120,122,124,126, 128. In other words, by grinding or otherwise suitably machining the surfaces 130,132,134,136,138,140, for example and without limitation, using a grinding wheel 200 (shown in simplified form in FIGS. 11 and 12) material is removed from the second side 108 of the shear 104 to form the desired configuration of high point contact areas 118, 120,122,124,126,128.

Figure 1A:
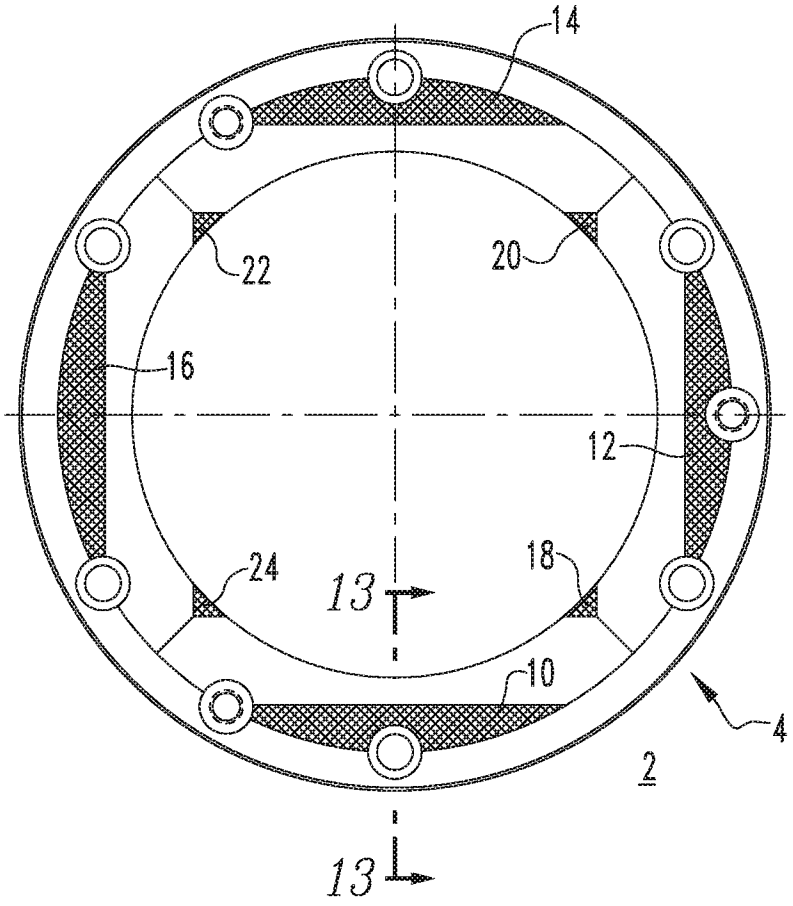
FIG. 1A PRIOR ART
FIG. 1A is a bottom plan view of a blanking tool having a 4-point shear.
Figure 2:
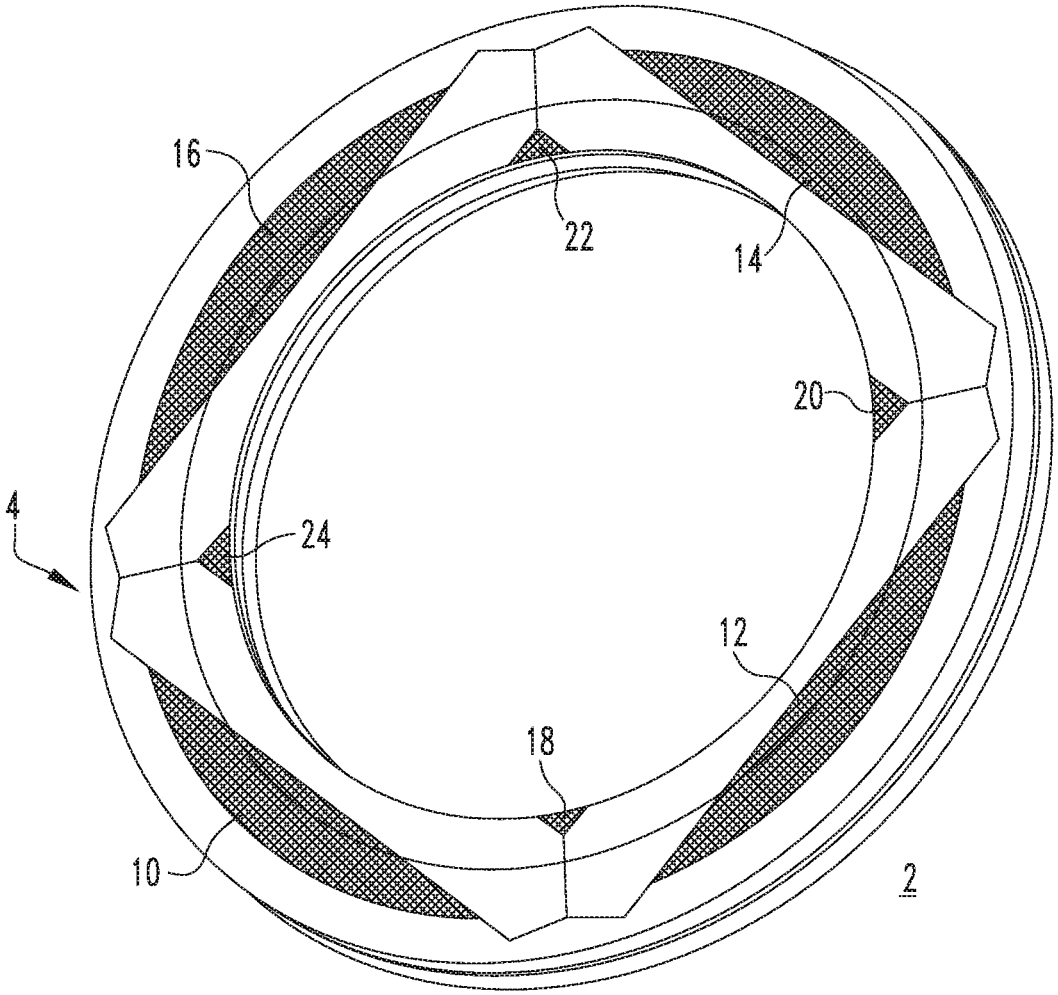
FIG.2 PRIOR ART
FIG. 2 is an isometric view of the 4-point shear of FIG. 1B.
Figure 3:
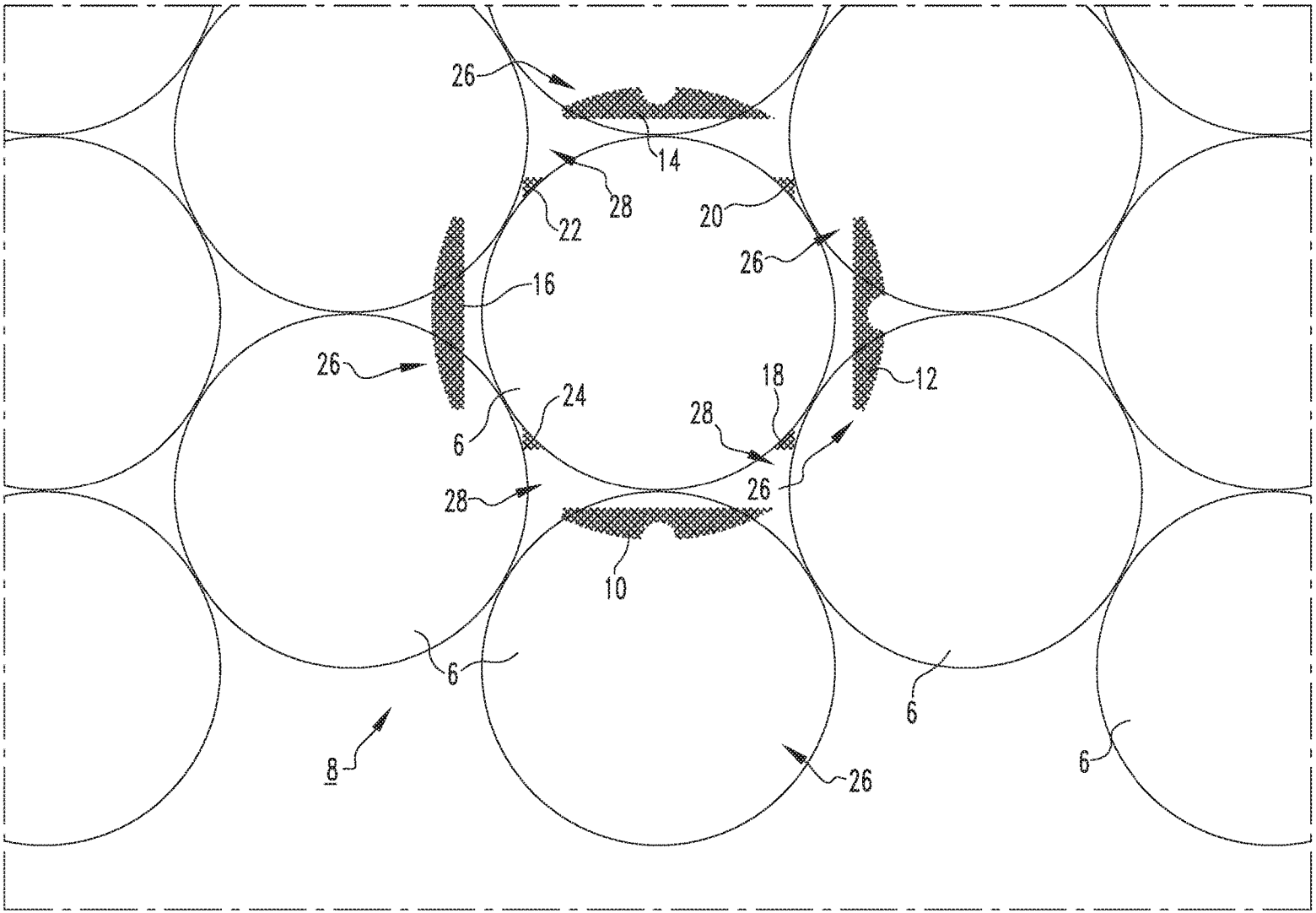
FIG. 3 PRIOR ART
FIG. 3 is a top plan view of a sheet of material, showing the location where blanks are formed and the areas where the 4-point shear contacts the material and the blanks.
Figure 4:
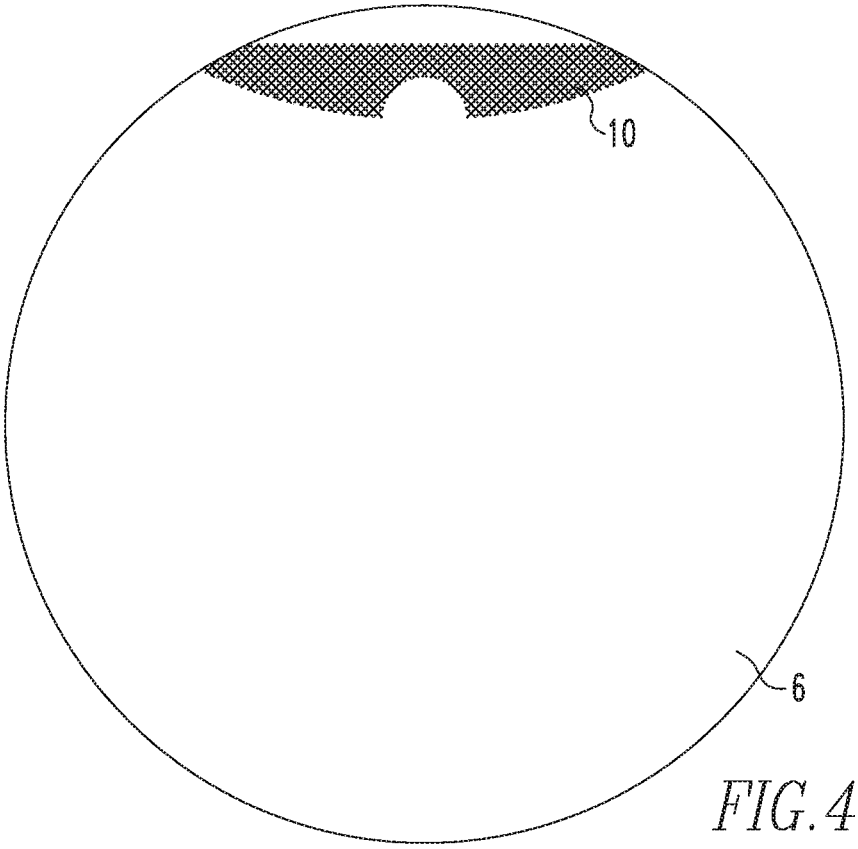
FIG. 4 is top plan view of one of the blanks of FIG. 3, showing a blemished area caused by tool contact.
Figure 5:
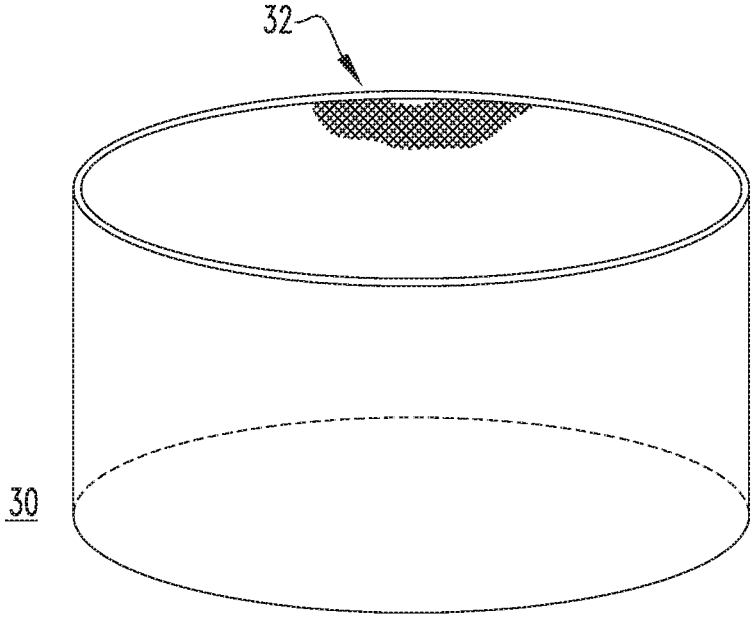
FIG. 5 is a simplified isometric view of a finished cup having been formed from the blemished blank of FIG. 4.
Figure 6B:
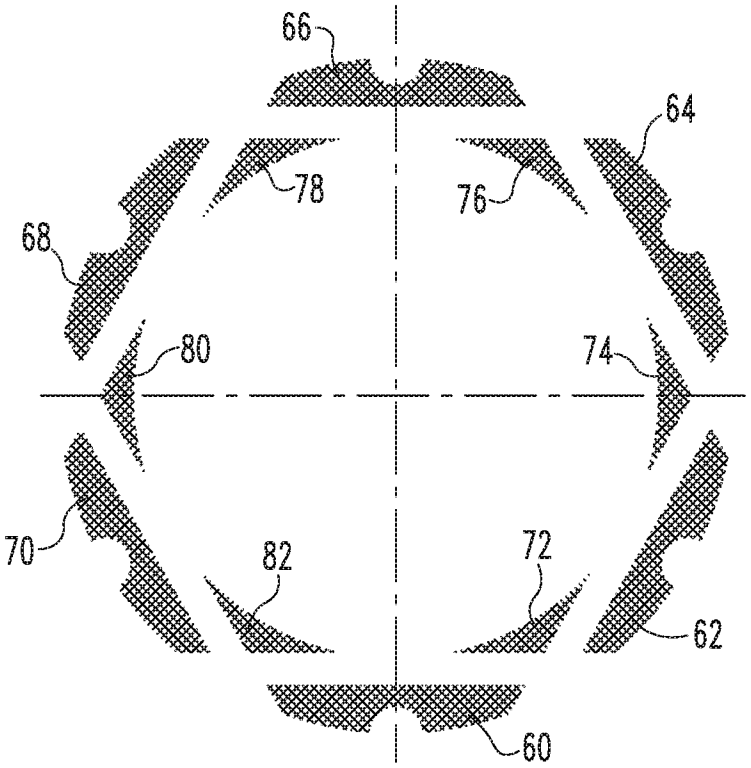
FIG. 6B is a plan view of the contact areas of the 6-point shear of FIG. 6A.
Figure 6A:
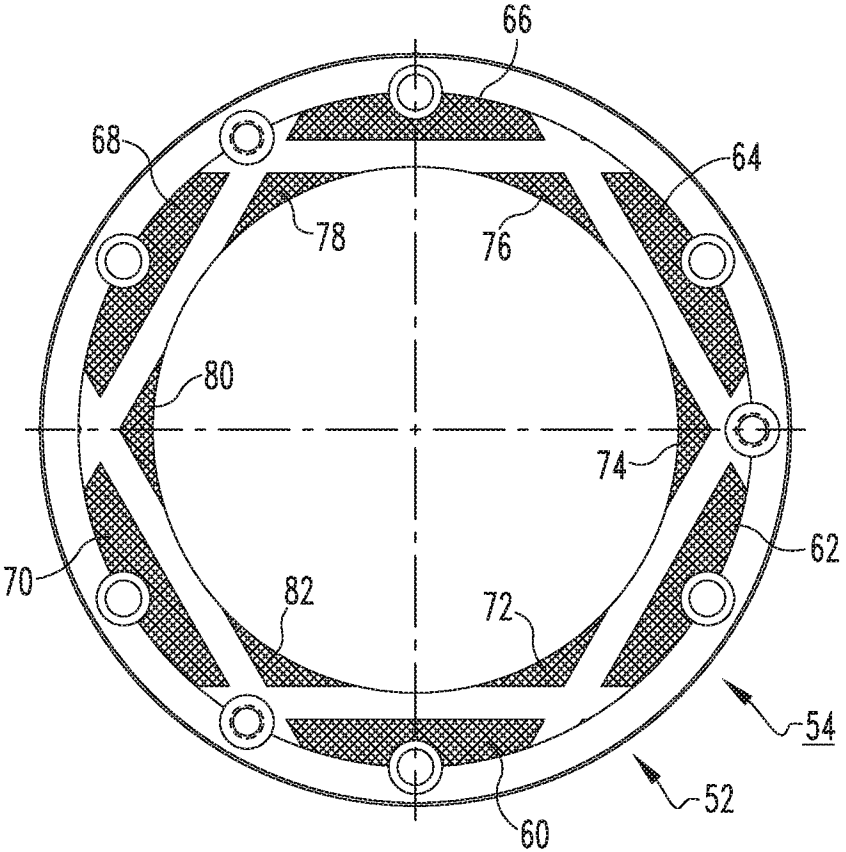
FIG. 6A is a bottom plan view of a blanking tool having a 6-point shear.
Figure 7:
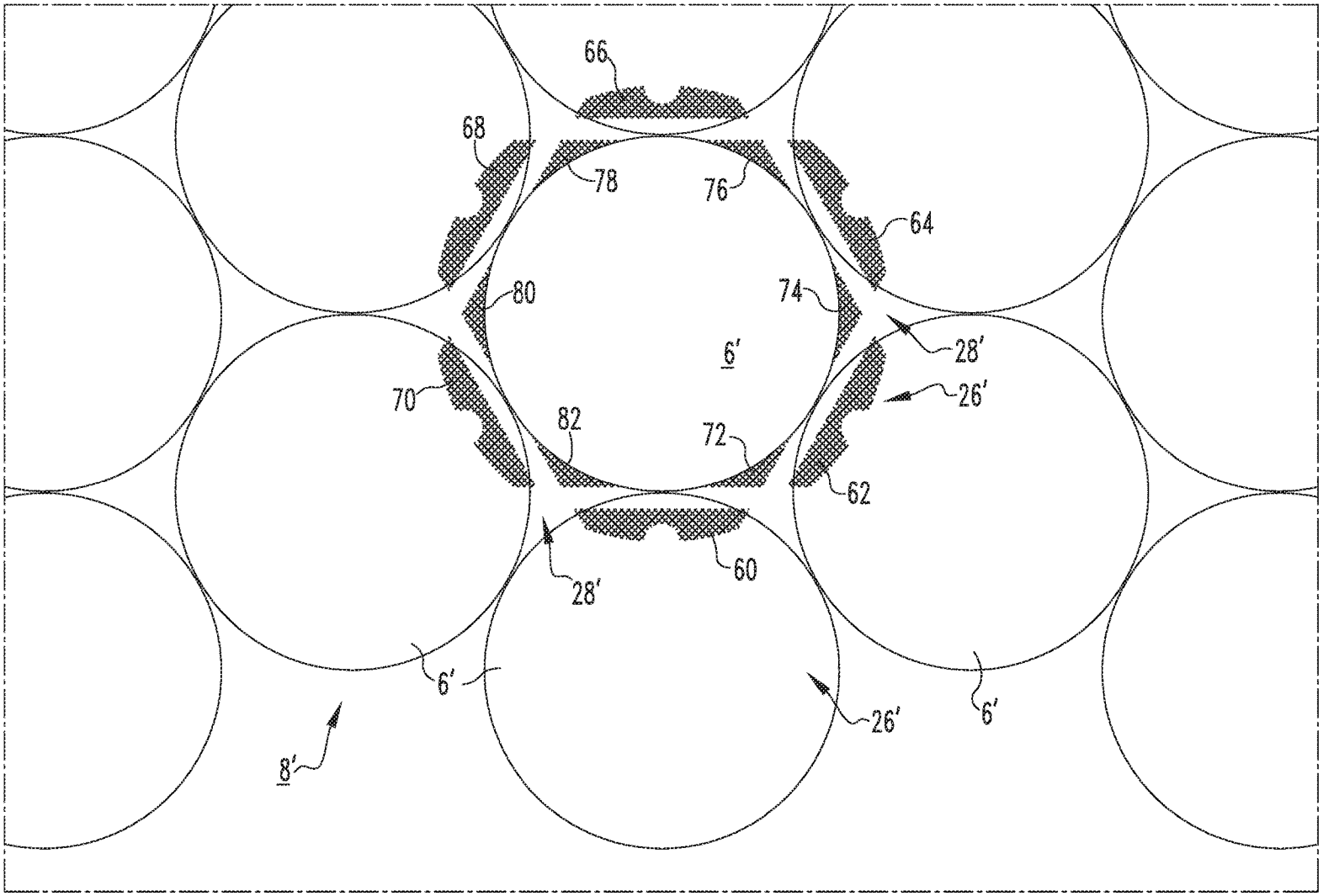
FIG. 7 PRIOR ART
FIG. 7 is a top plan view of a portion of a sheet of material, showing the location where blanks are formed and the areas where the 6-point shear contacts the material and the blanks.
Figure 10:
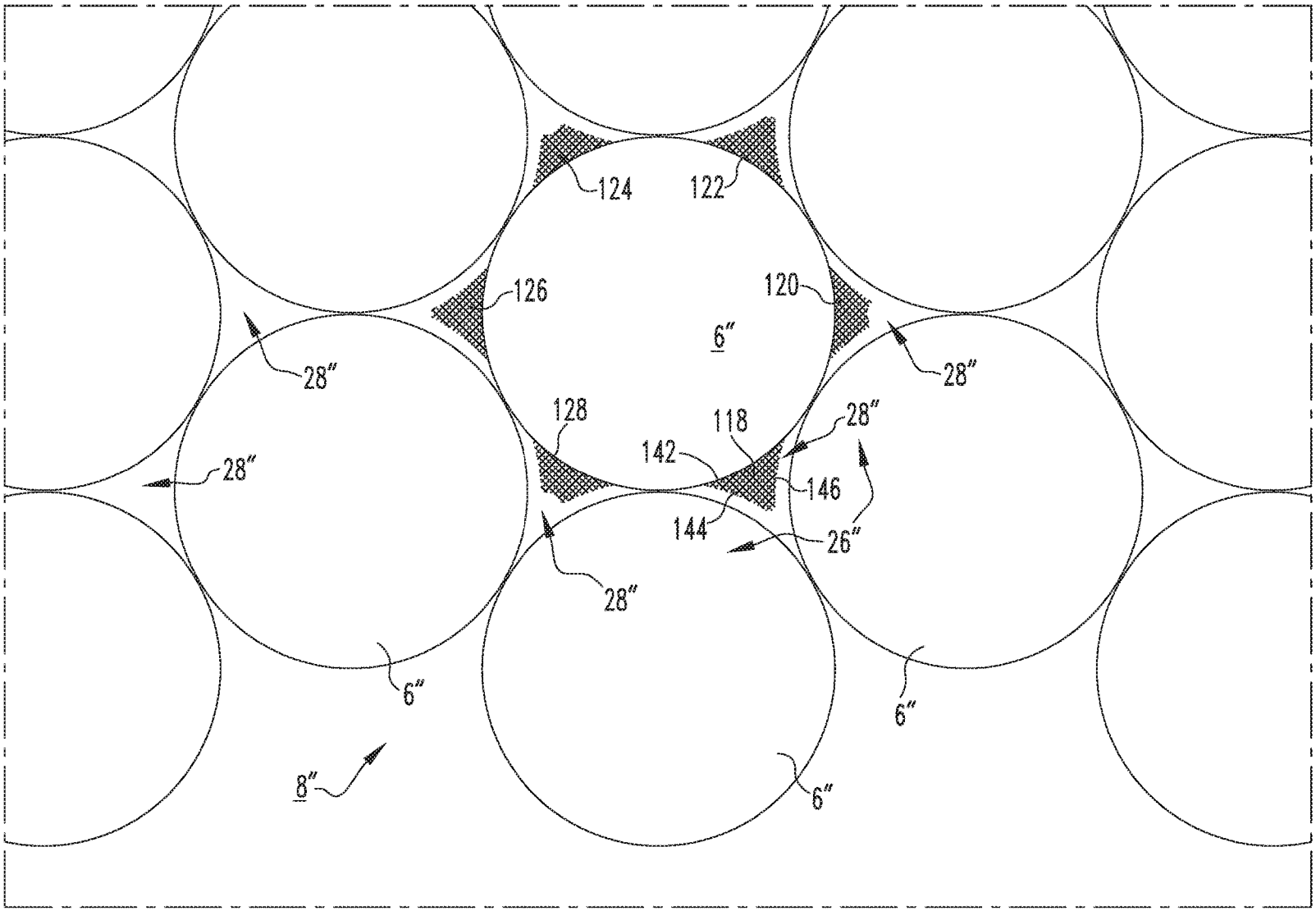
FIG. 10 is a top plan view of a portion of a sheet of material, showing the location where blanks are formed and the areas where the blanking tool contacts only the skeleton (i.e., scrap area, or web) of the material, in accordance with an embodiment of the disclosed concept.

It will be appreciated, therefore, that the disclosed concept involves selective machining of the blanking tool 102 to control the manner in which the shear 104 engages the material 8" (FIG. 10) from which blanks 6" (FIG. 10) are made. The contact areas 118,120,122,124,126,128 (e.g., pattern and/or location of contact) of the shear 104 (FIGS. 8, 9A, 11, 12, 14 and 15) with respect to the material 8" (FIG. 10), are best shown in FIGS. 9B and 10. It will be appreciated, with reference to FIG. 10, that as a result of the blanking process, the material 8" will include a product area 26", corresponding to the area of the material 8" where the blanks 6" are located, and a web or skeleton 28", corresponding to the area of scrap material between such blanks 6". The disclosed blanking tool 102 and, in particular, the contact areas 118,120,122,124,126,128 of the shear 104, engage only the web 28" of the material 8". In this manner, the disclosed blanking tool 102 advantageously avoids contacting, and thus scratching or otherwise blemishing (e.g., without limitation, scuffing; marring) or damaging the blanks 6". That is, unlike prior art blanking tools (see, for example, 4-point shear 4 of FIGS. 1A and 2; see also 6-point shear 54 of FIG. 6A), the disclosed shear 104 (FIGS. 8, 9A, 11, 12 and 15) does not contact the product area 26" of the material 8". Therefore, the blanks 6" are effectively sheared, without being contacted or damaged (e.g., without limitation, scratched or otherwise blemished). Accordingly, problems known to be associated with the prior art, such as damage caused to blanks (see blanks 6 of FIGS. 3 and 4; see also blanks 6' of FIG. 7) by the shear (see shear 4 of FIGS. 1A and 2; see also shear 54 of FIG. 6A), or by the stock plate (see, for example, stock plate 306 of FIGS. 15 and 16), during the blanking process resulting in a defect in the cup (see, for example, blemished cup 30 of FIG. 5), and ultimately in a potentially flawed finished product (e.g., without limitation, can body (not shown)), is eliminated.

Figure 11:
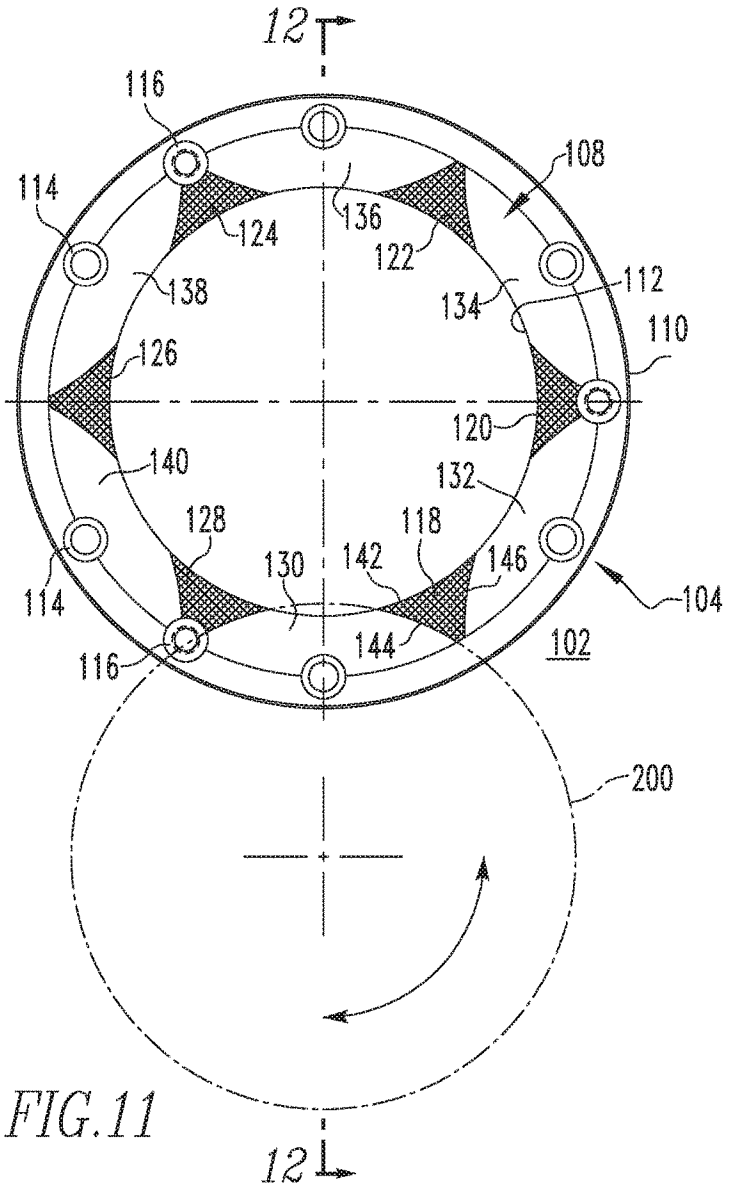
FIG. 11 is a bottom plan view of the blanking tool of FIG. 9A, also showing a grinding wheel in simplified form.

As shown in FIG. 10, the shape of each contact area 118,120,122,124,126,128 of the shear 104 is preferably shaped substantially similarly to the web or skeleton 28" of the material 8". Specifically, in the non-limiting example shown in FIGS. 9B, 10 and 11, contact area 118, for example, includes three arcuate sides 142,144,146. The first arcuate side 142 is substantially flush with respect to the inner edge of the shear 104, which defines the inner diameter 112 thereof, as shown in FIG. 11. The second arcuate side 144 is shaped substantially similarly to, and is generally parallel with respect to, the opposing corresponding arcuate portion of the web 28", which is defined by the removal of the blank 6" adjacent to side 144. Similarly, the third arcuate side 146 is shaped substantially similarly to, and is generally parallel with respect to, the opposing corresponding arcuate portion of the web 28", which is defined by the removal of the blank 6" adjacent to side 146. In other words, in the example shown and described herein, the contact area 118 generally has a triangular shape corresponding to the generally triangular shape of the corresponding portion of the web 28" of material 8", wherein each of the arcuate sides 142,144,146 is concave, as shown.

It will, however, be appreciated that any known or suitable alternative number, shape and/or configuration of contact areas (not shown) could be employed to engage only the web 28" of the material 8" in accordance with the disclosed concept.

Figure 12:
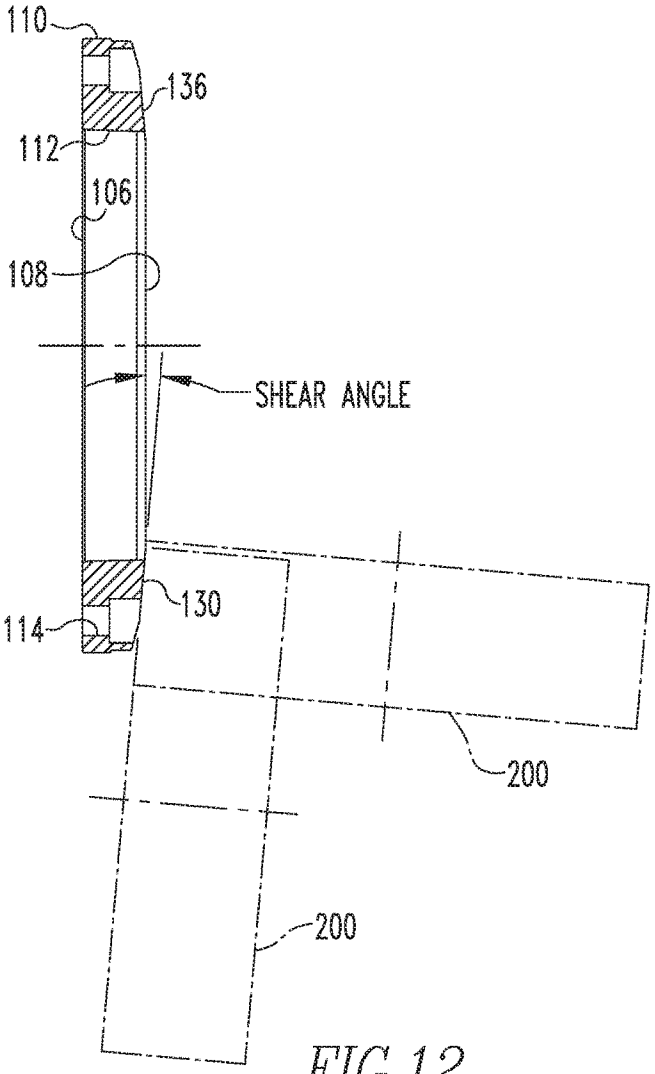
FIG. 12 is a section view taken along line 12-12 of FIG. 11.
Figure 14:
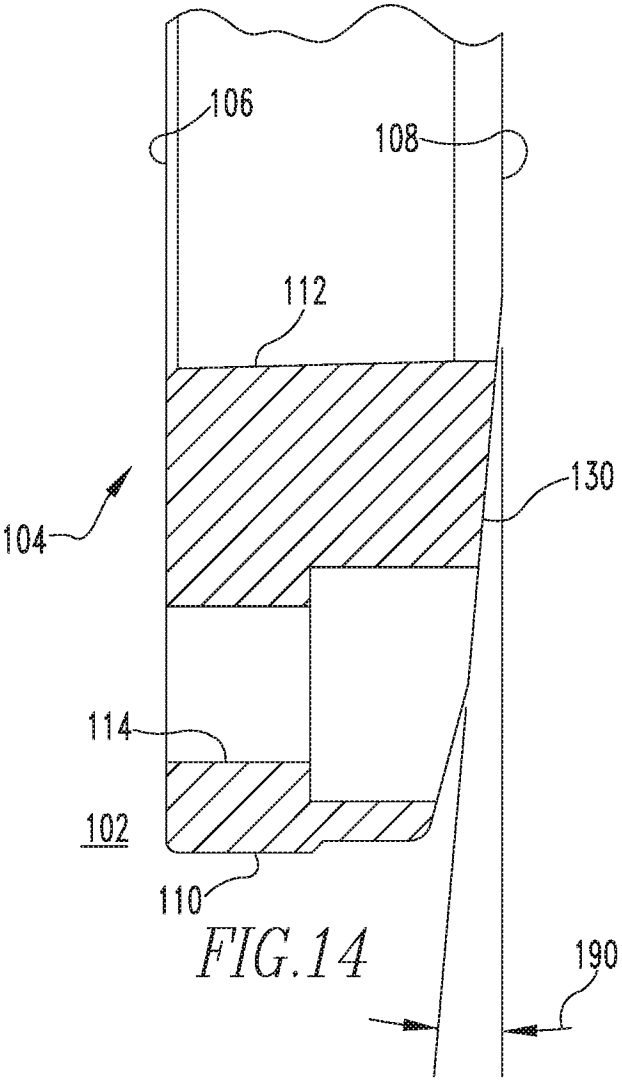
FIG. 14 is a section view taken along line 14-14 of FIG. 9A.
Figure 13:
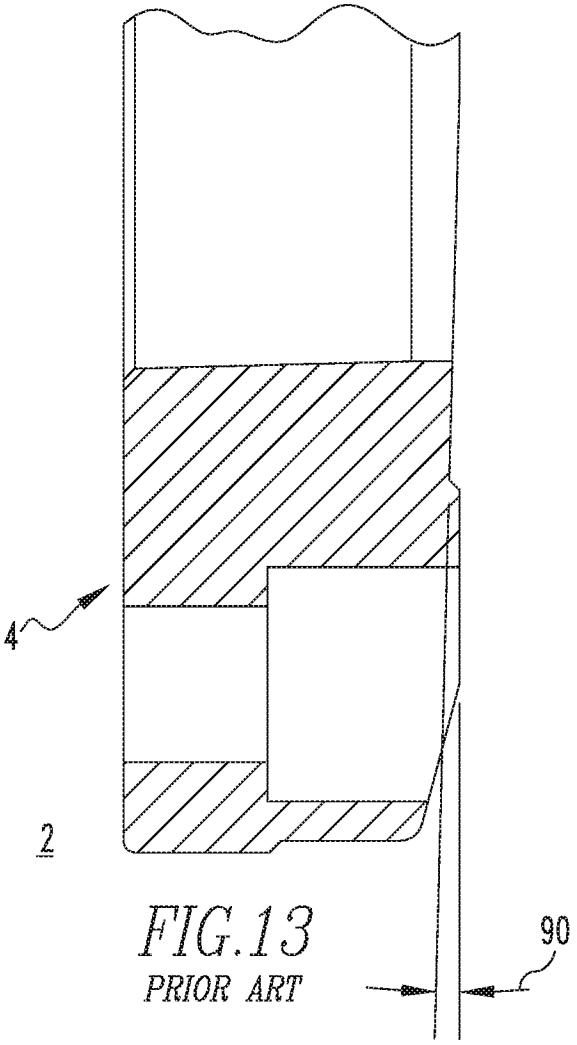
FIG. 13 PRIOR ART
FIG. 13 is a section view taken along line 13-13 of FIG. 1A.

FIGS. 11 and 12 show a grinding wheel 200 (shown in simplified form in phantom line drawing; also shown in FIG. 12 in an alternative vertical orientation) machined (e.g., without limitation, grinding) surface 130 to form the desired high-point contact areas 118,128 (FIG. 11) by removing material from the second side 108 of the shear 104, between the contact areas 118,128, as previously discussed. As shown in FIGS. 12 and 14, the machined surfaces, for example surface 130, between contact areas, for example contact areas 118,128, is preferably machined to have a desired predetermined shear angle 190 (best shown in the enlarged section view of FIG. 14). Comparing the shear angle 190 of FIG. 14 to the shear angle 90 of the prior art blanking tool 2 of FIG. 13, it will be appreciated that the machined surface 130 follows, or is disposed at, the shear angle 190, whereas the prior art shear 4 of FIG. 13 has no equivalent machined surface, and does not follow the shear angle 90 but rather includes an additional high point or contact area (see, for example, high point 10 of shear 4 of FIGS. 1A and 2). In the example of FIG. 14, the shear angle 190 is greater than the shear angle 90 of the prior art shear of FIG. 13, although it will be appreciated that the specific dimension of the shear angle 190 is not meant to be a limiting aspect of the disclosed concept. For example and without limitation, the shear angle 190 in accordance with one non-limiting embodiment of the disclosed concept could be up to about 30 degrees.

Figure 16:
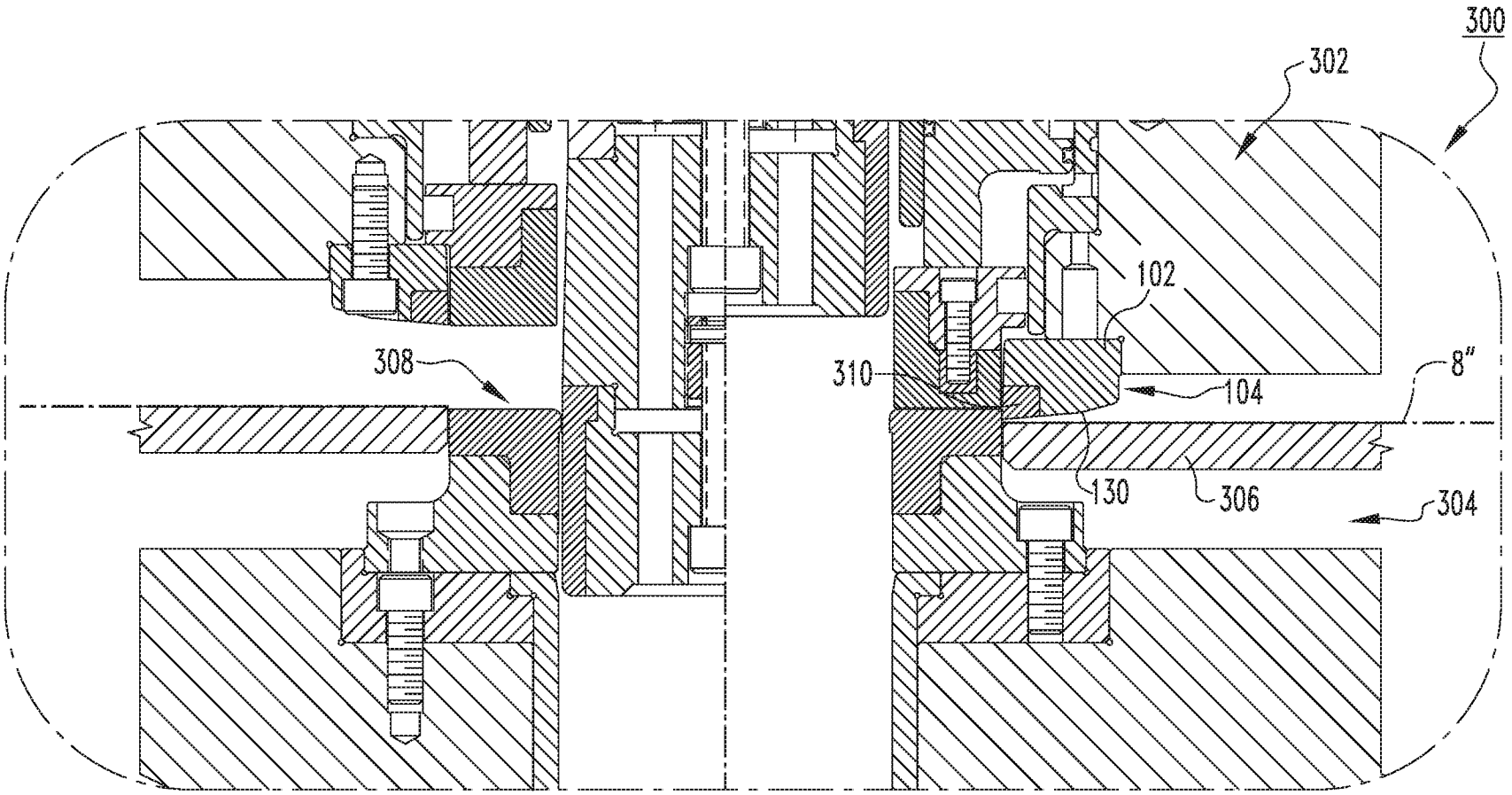
FIG. 16 is an enlarged view of a portion of the press and tooling assembly and blanking tool therefor of FIG. 15.

FIGS. 15 and 16 show the disclosed blanking tool 102 employed with a tooling assembly 300 of a press 400 (partially shown in section view), in accordance with a non-limiting embodiment of the disclosed concept. The tooling assembly 300 includes first tooling (e.g., upper tooling from the perspective of FIGS. 15 and 16, indicated generally by reference 302) and second tooling (e.g., lower tooling from the perspective of FIGS. 15 and 16, indicated generally by reference 304), which is disposed opposite from the upper tooling 302. The aforementioned sheet of material 8" (shown in simplified form in phantom line drawing in FIGS. 15 and 16) is fed into the press 400 between the upper tooling 302 and lower tooling 304. The shear 104 is coupled to the upper tooling 302 using any known or suitable fastening mechanism. For example and without limitation, the shear 104 shown and described herein, includes a number of bolt holes 114,116 (shown in FIGS. 9A, 11 and 12; not shown in FIG. 8 for simplicity of illustration) for bolting the blanking tool 102 to the upper tooling 302.

In operation, the sheet of material 8" is fed into the press 400, for example from a coil (not shown) or stack of such sheets (not shown), and the press 400 is actuated to advance the upper tooling 302 and, in particular, the shear 104, toward the lower tooling 304 and, in particular the stock plate 306, such that the material 8" is engaged and cut (e.g., shears) the material 8" to form the aforementioned blanks 6" (FIG. 10). The stock plate 306 supports the material 8" as it is fed through the tooling assembly 300 (e.g., without limitation, die set). During such blanking process, the aforementioned contact areas 118,120,122,124,126,128 (all shown in FIGS. 9A-11) of the shear 104 contact only the web or skeleton 28" of the material 8", as shown in FIG. 10 and as previously described hereinabove with respect thereto. The stock plate 306 is resilient (e.g., without limitation, supported by springs, pneumatically, or hydraulically) to allow it to move downward as the shear 104 pushes against it, with the material 8" trapped therebetween. After the blanking process, the stock plate 306 helps to lift the web or skeleton 28" (FIG. 10) portion of the material 8" while the blank 6" (FIG. 10) is drawn down through the blank and draw die 308 to form a cup (not shown, but see cup 30 of FIG. 5).

It will be appreciated that a further advantage of the disclosed blanking tool 102 is longer tool life. That is, in operation, the prior art shear (see, for example, shear 4 of FIGS. 1A and 2) impacts the stock plate 306 (with material 8" sandwiched therebetween) at relatively high speeds and tonnage, such that areas of the stock plate 306 opposite certain high points (see, for example, high points 18,20,22, 24 of FIGS. 1A-3) of the shear 4 (FIGS. 1A and 2) become worn. The disclosed shear 104, on the other hand, employs fewer contact areas 118,120,122,124,126,128 (six are shown), wherein each of the contact areas 118,120,122,124, 126,128 has a relatively large surface area (compare, for example, the relatively small surface area of high points 18,20,22,24 of shear 4 of FIGS. 1A and 2, to the relatively large surface area of high points 118,120,122,124,126,128 of the disclosed shear 104 (FIGS. 8, 9A and 11)). This improved design, with increased surface area, advantageously provides greater and more even load distribution of the impact load form the shear 104 than the prior art design. Accordingly, less wear to the stock plate 306 occurs.

To further reduce wear, the blanking tool 102 may optionally further include a carbide ring 310 inserted into the shear 104, as shown for example and without limitation in FIG. 16. That is, because carbide is very hard, the cutting or blanking edge of the tool 102 will last longer if the carbide ring 310 is employed. It will be appreciated that the carbide ring 310 preferably does not have any bearing on the geometry of the blanking tool 102.

Accordingly, the disclosed blanking tool 102 provides a shear 104 for effectively cutting (e.g., shearing) blanks 6" (FIG. 10), without engaging any portion of each blank 6" (FIG. 10). Therefore, damage (e.g., without limitation, scratching or otherwise blemishing) of the blank 6" during the blanking process is eliminated, thereby eliminating the potential for contact defects in the cup (see blemished cup 30 of FIG. 5) or end product (e.g., without limitation, container; beer/beverage can; food can (not shown)) formed from the blank 6", which is known to be associated with prior art blanking tools (see blanking tool 2 of FIGS. 1A and 2; see also blanking tool 52 of FIG. 6A).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A blanking tool for cutting a number of circular blanks from a sheet of material, said blanking tool comprising:

a shear comprising:

an inner edge defining a thru hole, an outer edge concentric with the inner edge, and a plurality of contact surfaces disposed between the inner edge and the outer edge, wherein every contact surface of said shear is positioned about the thru hole in the same radial positioning relative to the inner edge and extends from proximate the inner edge toward the outer edge, wherein said plurality of contact surfaces are defined by a plurality of machined surfaces, wherein each of said machined surfaces is a recessed area disposed between a pair of said plurality of contact surfaces, in order that said plurality of contact surfaces comprise high points on a side of said shear, and wherein the blanking tool is structured to cut blanks devoid of any holes or openings.

2. The blanking tool of claim 1 wherein each of said plurality of contact surfaces comprises an arcuate edge generally flush with the inner edge.

3. The blanking tool of claim 1 wherein said high points are disposed in a plane; and wherein said machined surfaces are disposed at a shear angle of between 0 degrees and 30 degrees with respect to the plane of said high points.

4. The blanking tool of claim 1 wherein each of said plurality of contact surfaces is triangular-shaped.

5. The blanking tool of claim 1 wherein said sheet of material comprises a product area corresponding to the area of said material where said blanks are located, and a web corresponding to the area of said material between said blanks; and wherein said plurality of contact surfaces are structured to avoid engagement with said product area of said material.

6. The blanking tool of claim 1 wherein the blanking tool is a six-point shear; and wherein none of the contact points of the six-point shear contact the blank.

7. The blanking tool of claim 1 wherein said plurality of contact surfaces are sized and positioned so as to only contact a web of material between adjacent blanks when cutting a maximum density of the circular blanks from the sheet of material with the blanking tool.

8. A tooling assembly for a press, said press being structured to receive a sheet of material to perform a number of machining operations thereto, said tooling assembly comprising:

first tooling structured to be coupled to a first portion of said press;

second tooling structured to be coupled to a second portion of said press opposite said first tooling, said first tooling and said second tooling being structured to cooperate to engage said sheet of material therebetween; and a blanking tool coupled to said first tooling, said blanking tool comprising:

a shear cooperating with a portion of said second tooling to cut a number of blanks from said material, said shear comprising:

an inner edge defining a thru hole, an outer edge concentric with the inner edge, and a plurality of contact surfaces disposed between the inner edge and the outer edge, wherein every contact surface of said shear is positioned about the thru hole in the same radial positioning relative to the inner edge and extends from proximate the inner edge toward the outer edge; wherein said plurality of contact surfaces are defined by a plurality of machined surfaces; and wherein each of said machined surfaces is a recessed area disposed between a pair of said plurality of contact surfaces, in order that said plurality of contact surfaces comprise high points on a side of said shear, and wherein the blanking tool is structured to cut blanks devoid of any holes or openings.

9. The tooling assembly of claim 8 wherein said blanking tool further comprises a plurality of holes in said shear and a plurality of fasteners; and wherein each of said fasteners extends through a corresponding one of said holes to fasten said shear to said first tooling.

10. The tooling assembly of claim 8 wherein said second tooling comprises a stock plate; wherein said stock plate is structured to support said material as said shear cuts said material to make said blanks.

11. The tooling assembly of claim 8 wherein said blanking tool further comprises a carbide ring; wherein said carbide ring is disposed on a side of said shear around the inner edge; and wherein said carbide ring comprises the blanking or cutting edge of said blanking tool.

12. The tooling assembly of claim 8 wherein each of said plurality of contact surfaces comprises an arcuate edge generally flush with the inner edge.

13. The tooling assembly of claim 8 wherein each of said plurality of contact surfaces is triangular-shaped.

14. The tooling assembly of claim 8 wherein said sheet of material comprises a product area corresponding to the area of said material where said blanks are located, and a web corresponding to the area of said material between said blanks; and wherein said plurality of contact surfaces are structured to avoid engagement with said product area of said material.

15. The tooling assembly of claim 8 wherein the blanking tool is a six-point shear; and wherein none of the contact points of the six-point shear contact the blank.

* * * * *